US010760458B2

(12) United States Patent
Clark

(10) Patent No.: US 10,760,458 B2
(45) Date of Patent: Sep. 1, 2020

(54) GROOVED ALIGNMENT DOWEL AND ENGINE ASSEMBLY

(71) Applicant: Ford Global Technologies, LLC, Dearborn, MI (US)

(72) Inventor: Stephen Leonard Clark, Bedford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 24 days.

(21) Appl. No.: 16/149,571

(22) Filed: Oct. 2, 2018

(65) Prior Publication Data

US 2019/0128156 A1 May 2, 2019

(30) Foreign Application Priority Data

Oct. 26, 2017 (GB) ..... 1717608.2

(51) Int. Cl.
*F01M 11/02* (2006.01)
*F01M 11/00* (2006.01)

(52) U.S. Cl.
CPC ..... *F01M 11/02* (2013.01); *F01M 11/0004* (2013.01); *F01M 2011/023* (2013.01)

(58) Field of Classification Search
CPC ..... F01M 11/02; F01M 11/0004; F01M 2011/023
See application file for complete search history.

(56) References Cited

U.S. PATENT DOCUMENTS 3,728,995 A * 4/1973 Schramm ..... F01M 11/00 123/195 A
2002/0124819 A1 9/2002 Lunsford
2004/0083990 A1 5/2004 Suzuki et al.
2004/0099240 A1 5/2004 Resh et al.
2014/0291230 A1* 10/2014 Fontecchio ..... B01D 29/114 210/323.1

(Continued)

FOREIGN PATENT DOCUMENTS

CN 202360540 U 8/2012
CN 202790481 U 3/2013

(Continued)

OTHER PUBLICATIONS

Nazareth, Grooved Pins, 2001, Nazareth Industrial Products, p. 6 Second Image.*

(Continued)

*Primary Examiner* — Jacob M Amick
*Assistant Examiner* — Charles Brauch
(74) *Attorney, Agent, or Firm* — Geoffrey Brumbaugh; McCoy Russell LLP

(57) ABSTRACT

An engine assembly is provided. The engine assembly comprises a first housing defining a first oil gallery, a second housing defining a second oil gallery, and an alignment dowel configured to be received within the first and second housings to provide an alignment feature for locating first and second housings of an engine assembly relative to one another, wherein the alignment dowel comprises a groove formed in an outer surface of the dowel configured to receive oil from the first oil gallery, and wherein the dowel is configured to provide a flow channel for the received oil to flow to the second oil gallery. An alignment dowel for use in the engine assembly is also provided.

19 Claims, 4 Drawing Sheets

(56) References Cited

U.S. PATENT DOCUMENTS

| | | | |
|---|---|---|---|
| 2016/0153327 | A1 | 6/2016 | Shewell |
| 2017/0284311 | A1 | 10/2017 | Son et al. |

FOREIGN PATENT DOCUMENTS

| | | | | |
|---|---|---|---|---|
| CN | 103343764 | A | * | 10/2013 |
| CN | 103343764 | A | | 10/2013 |
| CN | 105240151 | A | | 1/2016 |
| DE | 102011008988 | A1 | | 7/2012 |
| DE | 102012111466 | A1 | | 5/2014 |
| EP | 1321635 | A1 | | 6/2003 |
| EP | 2816213 | A2 | | 12/2014 |
| EP | 3232026 | A1 | | 10/2017 |
| JP | 2008196396 | A | | 8/2008 |
| KR | 20060009192 | A | | 1/2006 |

OTHER PUBLICATIONS

Great Britain Intellectual Property Office, Combined Search and Examination Report under Sections 17 and 18(3) Issued in Application No. GB1717608.2, dated Apr. 3, 2018, 7 pages.

* cited by examiner

GROOVED ALIGNMENT DOWEL AND ENGINE ASSEMBLY

CROSS REFERENCE TO RELATED APPLICATION

The present application claims priority to Great Britain patent application No. 1717608.2, entitled "AN ALIGNMENT DOWEL AND ENGINE ASSEMBLY", and filed on Oct. 26, 2017. The entire contents of the above-listed application are hereby incorporated by reference for all purposes.

FIELD

The present disclosure relates to an alignment dowel for an engine assembly.

BACKGROUND/SUMMARY

With reference to FIG. 1, a prior art engine assembly 2 is shown including two or more housings, such as a cylinder block 4 and a cylinder head 6. The engine housings are typically coupled together using one or more fasteners, such as cylinder head bolts (not shown) and one or more dowels 8, which provided alignment features for locating the cylinder block and cylinder head relative to one another before the fasteners are installed. As depicted, the dowel 8 is typically received within bores formed in the cylinder block and cylinder head that are aligned, e.g., axially aligned, when the engine housings are correctly located relative to one another.

The engine assembly 2 further includes a sump pan 10 configured to form a reservoir 11 for engine oil to be stored in when it is not being circulated around the engine assembly 2. In use, engine oil is pumped from the reservoir 11 in the sump pan 10 into a first oil gallery 12, formed in the cylinder block 4. Oil from the first oil gallery 12 is distributed to the oil consuming components associated with the cylinder block 4 of the engine assembly 2.

A second oil gallery 14 is formed in the cylinder head 6 to distribute oil to the oil consuming components associated with the cylinder head. An oil passage 16 extends from the first oil gallery 12 to the second oil gallery 14 to provide a supply of oil to the second oil gallery. As depicted, the oil passage 16 extends across the joint between the engine housings 4, 6, and hence, a seal, such as a gasket 18, is typically provided between the engine housings around the oil passage 16 to seal the oil passage at the joint between engine housings 4, 6. An oil restrictor 20 may be provided within the oil passage 16. The restrictor comprises an orifice 20*a* providing a flow area of a predetermine size, which limits the flow rate of oil through the oil passage 16. The oil restrictor 20 is typically installed into the oil passage 16 by push fitting the restrictor 20 into the oil passage 16 where it is retained by a virtue of an interference fit between the oil restrictor 20 and the oil passage. The inventors have recognized several drawbacks with the prior art engine assembly 2 shown in FIG. 1. For instance, during engine assembly the interaction between the oil restrictor 20 and the oil passage 16 may create debris (e.g., chips, swarf, etc.). The debris, for example, may be created when the restrictor is inserted into the oil passage due to the interference fit between the passage and the restrictor and the rotation between the components. Debris in the lubrication system can lead to unwanted wear of lubricated components downstream of the restrictor. As a result, the longevity of the engine is decreased.

In one example, the issues described above may be addressed by an engine assembly including a first housing defining a first oil gallery and a second housing defining a second oil gallery. The engine assembly further includes an alignment dowel configured to be received within the first and second housings to provide an alignment feature for locating a first and second housings of an engine assembly relative to one another. The alignment dowel includes an oil receiving groove formed in an outer surface of the alignment dowel configured to receive oil from the first oil gallery. Additionally, the alignment dowel is configured to provide a flow channel for the oil received in the oil receiving groove to flow to the second oil gallery, the oil receiving groove extends across the outer surface of the alignment dowel, and a centerline of the oil receiving groove extends in a direction with a component in a circumferential direction of the alignment dowel. Providing an alignment dowel with the oil receiving groove allows a constriction to be formed at the intersection between the oil galleries. Consequently, a desired oil flow pattern can be generated in the engine assembly that improves engine lubrication. Moreover, circumferentially positioning the oil receiving groove enables the dowel to be installed in multiple orientations which allow the dowel to provide a desired oil flow pattern in the engine assembly. For instance, in one example, the dowel's radial and/or longitudinal orientation may not be taken into account when the dowel is installed in the oil galleries. As a result, engine manufacturing efficiency is increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

BRIEF DESCRIPTION OF THE DRAWINGS

For a better understanding of the present invention, and to show more clearly how it may be carried into effect, reference will now be made, by way of example, to the accompanying drawings, in the drawings:

FIGS. 3, 4, 5, and 7 are shown approximately to scale. However, other relative dimension may be used, if desired.

DETAILED DESCRIPTION

Figure 1:
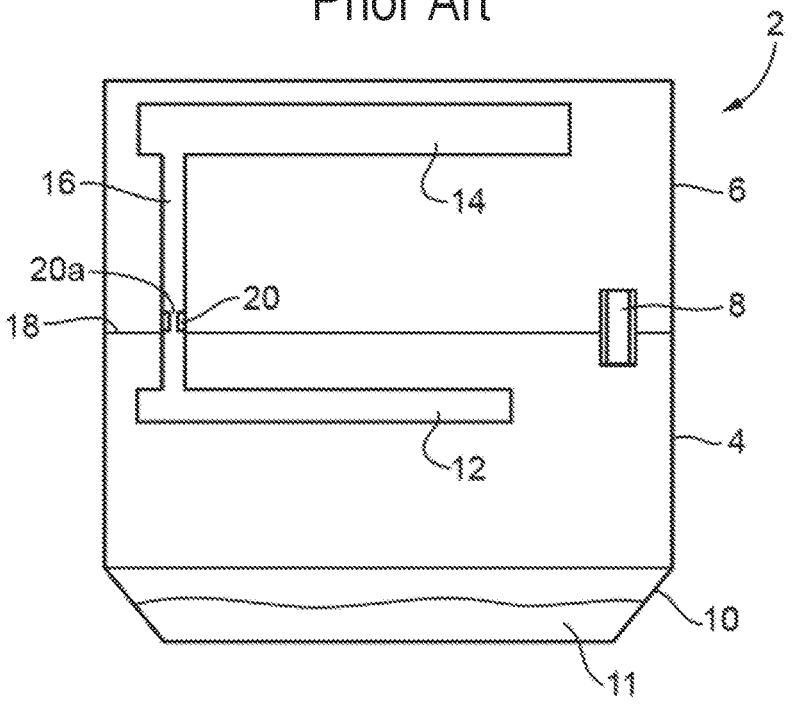
FIG. 1 Prior Art
FIG. 1 is a schematic sectional view of a prior art engine assembly.

According to an aspect of the present disclosure, there is provided an engine assembly including a first housing defining a first oil gallery, a second housing defining a second oil gallery, and an alignment dowel configured to be received within the first and second housings to provide an alignment feature for locating first and second housings of an engine assembly relative to one another, wherein the alignment dowel comprises an oil receiving groove formed in an outer surface of the dowel configured to receive oil from the first oil gallery, wherein the dowel is configured to provide a flow channel for the received oil to flow to the second oil gallery, wherein the oil receiving groove extends across the outer surface of the dowel, and wherein a centerline of the oil receiving groove extends in a direction with a component in a circumferential direction of the dowel.

The first oil gallery may extend in a direction perpendicular to a main axis of the dowel at the position where the first oil gallery meets the alignment dowel. Alternatively, the first oil gallery may extend in a direction parallel to a main axis of the dowel at the position where the first oil gallery meets the alignment dowel.

The first oil gallery may meet the alignment dowel at a position between longitudinal ends of the dowel.

The alignment dowel may comprise a central bore. The central bore may at least partially form the flow channel for the received oil.

The first housing may further define a third oil gallery. The dowel and the third oil gallery may be arranged such that oil from the third oil gallery flows through the central bore to the second oil gallery. For example, the oil from the third oil gallery may flow into the central bore through an opening in a longitudinal end face of the alignment dowel.

The third oil gallery may extend in a direction perpendicular to a main axis of the alignment dowel at a position where the third oil gallery meets the alignment dowel. Alternatively, the third oil gallery may extend in a direction parallel to the main axis of the alignment dowel where the third oil gallery meets the alignment dowel.

The first housing may comprise a cylinder block and the second housing may comprise a cylinder head. Alternatively, the first housing may comprise a first cylinder head housing and the second housing may comprise a camshaft carrier, e.g., a second cylinder head housing.

The alignment dowel may comprise an oil channel formed between the oil receiving groove and the central bore. The oil channel may comprise a radially extending passage between the oil receiving groove and the central bore.

The alignment dowel may further comprise an oil filter arranged to filter oil passing through the flow channel provided by the dowel. For example, the oil filter may be provided within the central bore of the dowel.

An oil passage may extend from the alignment dowel, in a direction with a component parallel with a main axis of the dowel, to the second oil gallery, e.g., in a direction substantially parallel with a main axis of the dowel.

According to another aspect of the present disclosure, there is provided an alignment dowel configured to provide an alignment feature for locating first and second housings of an engine assembly relative to one another, wherein the dowel comprises an oil receiving groove formed in an outer surface of the dowel configured to receive oil from a first oil gallery defined by the first housing, wherein the dowel is configured to provide a flow channel for the oil received in the groove to flow into a second oil gallery defined by the second housing, wherein the oil receiving groove extends across the outer surface of the dowel, and wherein a centerline of the oil receiving groove extends in a direction with a component in a circumferential direction of the dowel. For example, the flow channel may extend in an axial direction of the dowel so as to pass between the first and second housings.

The oil receiving groove may extend across the outer surface of the dowel. A centerline of the oil receiving groove may extend in a direction with a component in a circumferential direction of the dowel. The centerline of the oil receiving groove may extend at least once around the complete circumference of the dowel, e.g., 360 degrees about the main axis of the dowel.

The oil receiving groove may form a continuous loop about a central axis of the dowel, e.g., such that a first end of the oil receiving groove is joined to a second end of the oil receiving groove.

An oil flow area defined by the oil receiving groove may be sized so as to provide a predetermined flow of oil through the oil receiving groove. For example, a width and/or depth of the oil receiving groove may be selected in order to provide a desired flow area for metering oil between the first and second housings.

The alignment dowel may further comprise an axial groove formed in the outer surface of the dowel between the oil receiving groove and a longitudinal end face of the dowel. The axial groove may form the flow channel for oil.

The alignment dowel may comprise a central bore. The central bore may at least partially form the flow channel for the received oil. The alignment dowel may further comprise an oil channel formed between the oil receiving groove and the central bore.

The alignment dowel may comprise an opening of the central bore provided in a first longitudinal end face of the dowel, e.g., to enable oil to flow from the central bore into the second oil gallery.

The alignment dowel may comprise a further opening of the central bore provided in a second longitudinal end face of the dowel, e.g., opposite the first longitudinal end face.

The opening and further opening may together enable oil to flow from a third oil gallery formed in the first housing to the second gallery through the central bore. Alternatively, the oil restrictor may not comprise a further opening.

The alignment dowel may further comprise an oil filter arranged to filter oil passing through the flow channel. For example, the oil filter may be provided within the central bore.

Figure 2:
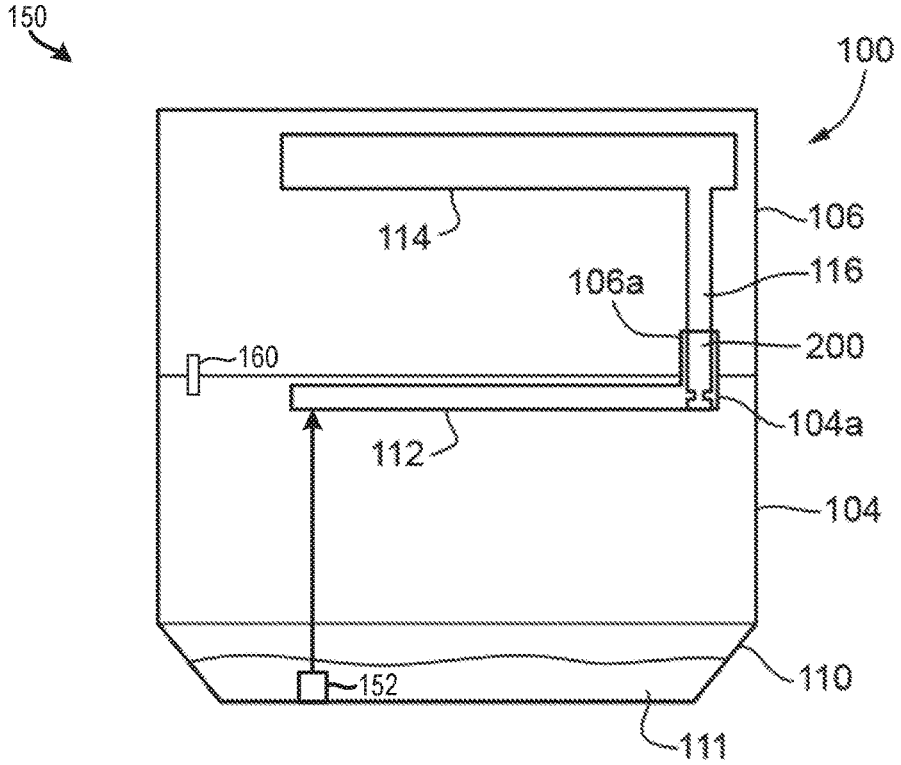
FIG. 2 is a schematic sectional view of an engine assembly according to arrangements of the present disclosure.

With reference to FIG. 2, an engine assembly 100 according to arrangements of the present disclosure, comprises a first engine housing 104, such as a cylinder block, and a second engine housing 106, such as a cylinder head. Thus, first engine housing 104 (e.g., the cylinder block) and the second engine housing 106 (e.g., cylinder head) may be included in an engine 150 having one or more combustion chambers therein. The engine may be configured to carry out combustion cycles in the combustion chambers. As such, the engine may include components such as intake valves, exhaust valves, pistons, etc., for implementing combustion.

An alignment dowel 200 according to arrangements of the present disclosure is received within first and second bores 104*a*, 106*a*, formed in the first and second engine housings 104, 106 respectively, and provides an alignment feature for locating the first and second housings relative to one another before the first and second housings are coupled together, e.g., using one or more fasteners 160, such as cylinder head bolts. As such, the alignment dowel 200 may extend into opening in both the first and second engine housings 104, 106. Furthermore, the alignment dowel 200 may not have an interference fit with the openings in the first and second engine housings 104, 106, in one example. That is to say that the fit may accommodate a small amount of movement between the dowel and the openings. However, the alignment dowel 200 may be attached to the first and/or second engine housings 104, 106 via numerous suitable techniques.

The engine assembly 102 may further comprise an oil sump 110 (e.g., sump pan), which forms a reservoir 111 for engine oil.

A first oil gallery 112 is defined within the first engine housing 104 for supplying oil to one or more oil consuming components associated with the first engine housing 104. Oil may be pumped from the reservoir within the sump pan to the first oil gallery 112. The oil pumping may be carried out via an oil pump 152 (e.g., sump pump). The oil pump 152 is shown in fluidic communication with the first oil gallery 112. Additionally or alternatively, the oil pump 152 may be in fluidic communication with a second oil gallery 114. The second oil gallery 114 is defined within the second engine housing 106 for supplying oil to oil consuming components associated with the second engine housing. The oil consuming components described herein may include but are not limited to crankshafts, camshafts, pistons, etc.

In the arrangement depicted in FIG. 2, the first oil gallery 112 is arranged in fluid communication with the first bore 104*a*. Hence, when the engine assembly is assembled, and the alignment dowel 200 is received within the first bore 104*a*, oil is provided by the first oil gallery 112 to the alignment dowel 200.

As shown in FIG. 2, a portion of the first oil gallery 112 may extend in a direction perpendicular to a main axis 154 (e.g., longitudinal axis) of the dowel, e.g., a lateral direction of the engine assembly 100, to meet the alignment dowel 200.

The alignment dowel 200 is configured to provide a flow channel for oil to flow from the first oil gallery 112 to the second housing 106, e.g., to the second bore 106*a*. As shown, an oil passage 116 may be formed between the second bore 106*a* and the second oil gallery 114, so that oil can flow from the first oil gallery 112 to the second oil gallery 114 via the alignment dowel 200. The oil passage 116 may be part of the second oil gallery 114.

Figure 3:
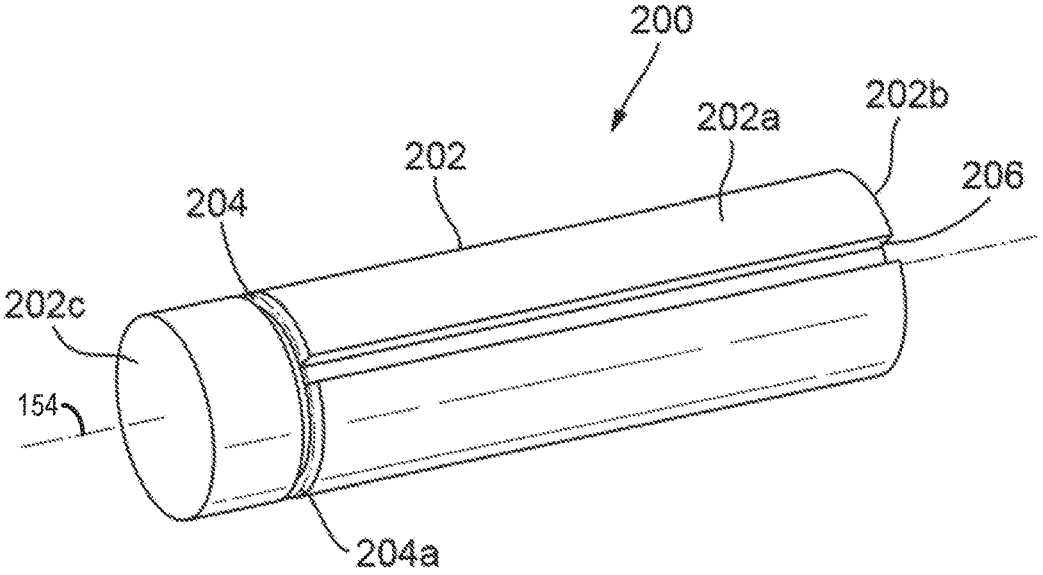
FIG. 3 is a perspective view of an alignment dowel according to an arrangement of the present disclosure.
Figure 4:
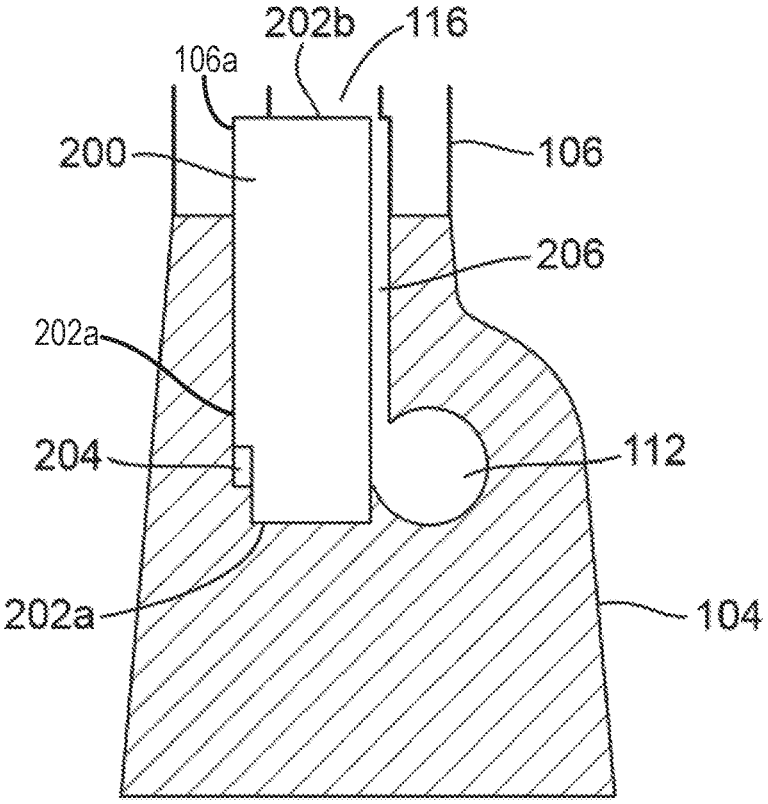
FIG. 4 is a sectional view of the alignment dowel shown in FIG. 3 installed within the engine assembly shown in FIG. 2.

With reference to FIGS. 3 and 4, the alignment dowel 200 may comprise a substantially cylindrical body 202 having outer surface 202*a*, configured to engage the inner surfaces of the first and second bores 104*a*, 106*a*, and first and second longitudinal ends 202*b*, 202*c* (e.g., longitudinal end faces).

The alignment dowel 200 comprises an oil receiving groove 204 formed in the outer surface of the alignment dowel 200, e.g., at a position between the longitudinal ends of the dowel 200. The groove 204 is formed such that when the dowel 200 is provided in the first bore 104*b*, the groove 204 is able to receive oil from the first oil gallery 112. The first oil gallery 112 may meet the alignment dowel 200 at a position between the longitudinal ends of the dowel 200, e.g., aligned with the oil receiving groove 204. The main axis 154 of the alignment dowel 200 is also shown in FIG. 3.

The groove 204, e.g., a centerline 204*a* of the groove, may extend over the outer surface of the alignment dowel in a direction having a component in a circumferential direction of the dowel. For example, as shown in FIG. 3, the groove may extend circumferentially around the complete circumference of the dowel 200. In the arrangement shown in FIG. 3, the groove 204 forms a continuous loop around the dowel 200. In this way, the relative orientation (e.g., radial and/or longitudinal orientation) of the dowel may not need to be taken into account when the engine housings are joined during manufacturing, if desired. As a result, engine manufacturing is simplified, thereby reducing engine manufacturing costs and reducing the likelihood of improper dowel installation with regard to the oil flow.

The groove 204, e.g., the groove centerline 204*a*, may also extend in a direction with a component in an axial direction of the dowel 200. For example, the groove 204 may form a spiral about the main axis of the dowel 200 or may form a loop about an axis that is arranged at an angle to the main axis of the dowel 200. Therefore, in one example, the groove 204 may at least partially circumferentially surround the dowel 200. Specifically, in one example, the groove 204 may completely circumferentially surround the dowel 200.

Although in the arrangement shown, a single oil receiving groove 204 is shown, in other arrangements, the dowel 200 may comprise one or more additional oil receiving grooves configured to receive oil from the first oil gallery 112 or one or more further oil galleries. For example, the oil receiving grooves may be spaced axially along the alignment dowel 200.

When the groove 204 extends in a circumferential direction over the outer surface 202*a* of the dowel 200, it may improve alignment between the oil receiving groove and the first oil gallery, so that the first oil gallery is in fluid communication with the first oil gallery 112, regardless of the orientation of the dowel 200, e.g., angle of the dowel about its main axis, within the first bore 104*a*.

In other arrangements, the oil receiving groove 204 may extend in a direction parallel to the axial direction of the dowel 200. In such arrangements, the oil receiving groove 204 may be aligned with the first oil gallery 112 when the alignment dowel 200 is inserted into the first bore 104*a*.

The oil receiving groove 204 may be sized so as to provide a predetermined flow area for oil to flow though through the groove 204. For example, a depth and width of the groove may be selected in order to provide a desired flow area. The alignment dowel 200 may thereby be configured to perform the function of an oil restrictor provided within the engine assembly, in addition to the locating function of the dowel.

In the arrangement depicted in FIGS. 3 and 4, the dowel 200 further comprises an axial groove 206 extending from the oil receiving groove 204 to a first longitudinal end 202*b* of the dowel 200. The axial groove 206 is in fluid communication with the oil receiving groove 204 and the second bore 106*a*.

A flow area provided by the axial groove may be the predetermined flow area. In other words, a flow area provided by the axial groove 206 may be substantially the same as the flow area provided by the oil receiving groove 204. Alternatively, the flow area provided by the axial groove 206 may be greater that the predetermined flow area.

As described above, the second bore 106*a* is in fluid communication (via the oil passage 116) with the second oil gallery 114, shown in FIG. 2. The axial groove 206 therefore forms the flow channel for oil to flow from the first oil gallery 112 to the second housing 106 through the alignment dowel 200.

Figure 5:
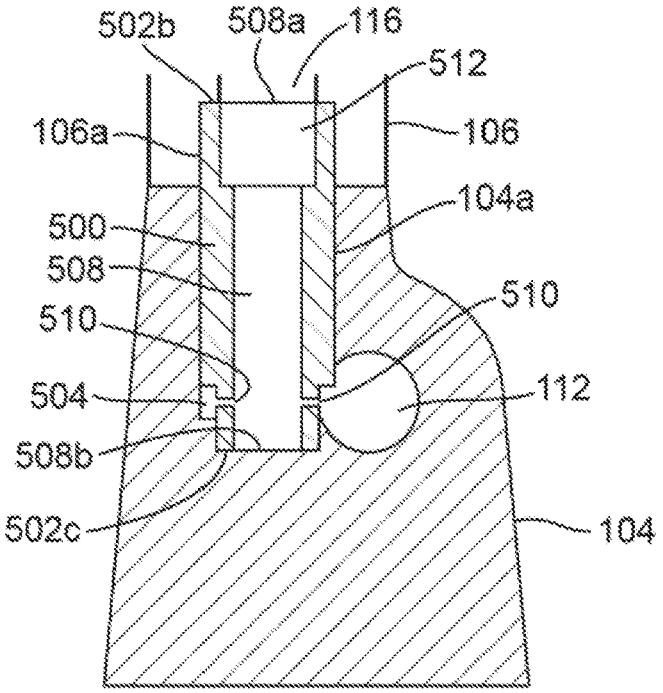
FIG. 5 is a section view of an alignment dowel according to another arrangement of the present disclosure installed within the engine assembly shown in FIG. 2.

With reference to FIG. 5, in addition or as an alternative to the axial groove 206, an alignment dowel 500 may comprise a central bore 508. The central bore 508 may extend between first and second longitudinal end faces 502*b*, 502*c* of the dowel 500. In the arrangement depicted, first and a second openings 508*a*, 508*b* of the central bore are formed in the first and second longitudinal end faces 502*b*, 502*c* of the dowel respectively. The central bore 508 is thereby in fluid communication with the oil passage 116, e.g., via the first opening 508*a*. In some arrangements, the second opening 508*b* may be omitted.

A flow area for oil provided by the central bore 508 may be greater than the predetermined flow area. Hence, the central bore 508 may not restrict the flow of oil between the first and second oil galleries 112, 114. Alternatively, at least a portion of the central bore may define a flow area substantially equal to the predetermined flow area.

The alignment dowel 500 further comprises an oil receiving groove 504, which is similar to the oil receiving groove 204 described above. An oil channel 510 is formed between the oil receiving groove 504 and the central bore 508. The oil channel 510 and the central bore 508 thereby form the flow channel for oil from the first oil gallery 112 to flow into the second housing 106, e.g., to the second oil gallery 114.

When the flow channel between the first and second engine housings 104, 106 is formed by the central bore 508 of the alignment dowel 500. Oil is prevented from leaking at the joint between the engine housings by the dowel. Hence, gasket material is not required between the engine housings in the area of the dowel for the purpose of preventing oil leakage, if desired.

In the arrangement shown, two oil channels 510 are formed between the oil receiving groove 504 and the central bore 508, which are diametrically opposite one another, e.g., 180 degrees apart around the alignment dowel 500. However, in other arrangements, different numbers of oil channels 510 may be provided, which may be spaced apart around the alignment dowel, e.g., circumferentially, by any desirable angle or angles.

The oil channel or channels 510 may define a flow area substantially equal to the predetermined flow area. The oil channels 510 may thereby be configured to restrict the flow of oil from the first oil gallery 112 to the second housing 106. In such arrangements, the flow area of the oil receiving groove 504 may be greater than the predetermined flow area.

An oil filter 512 may be provided within the central bore 508 to filter the oil passing through the alignment dowel. As shown in FIG. 5, the oil filter 512 may be provided in a portion of the central bore 508 adjacent to, e.g., extending from, the first longitudinal end face 502*b* of the dowel 500. The oil filter 512 may be received within a portion of the central bore having a greater diameter than the remaining portion of the central bore, e.g., the portion not receiving the oil filter 512.

When the engine assembly 100 is assembled, the first longitudinal end face 502*b* of the dowel may abut or be arranged close to an end face of the second bore 106*a*, so that the oil filter 512 is retained within the central bore 506 by the end face of the second bore 106*a*.

Figure 6:
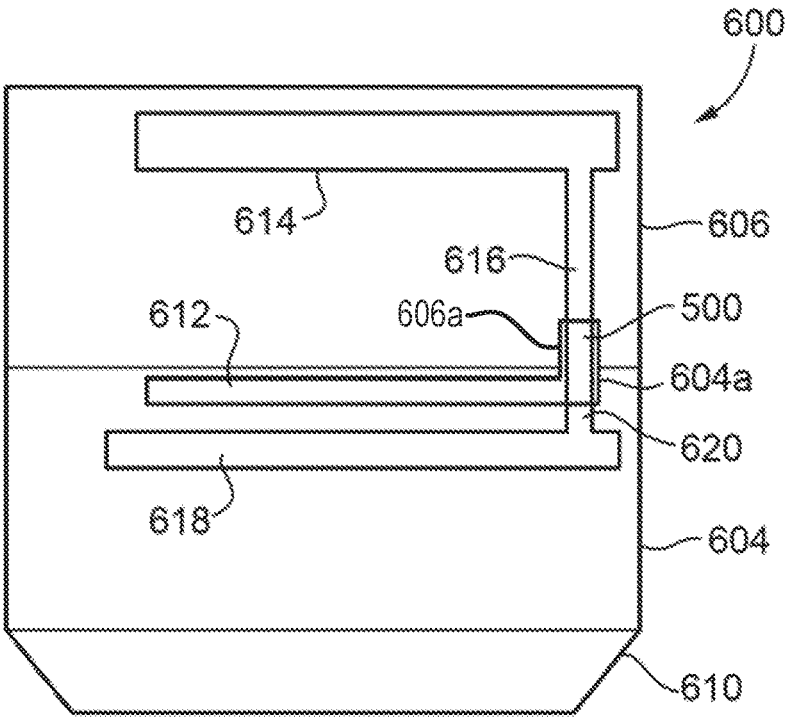
FIG. 6 is a schematic sectional view of an engine assembly according to one or more further arrangements of the present disclosure.
Figure 7:
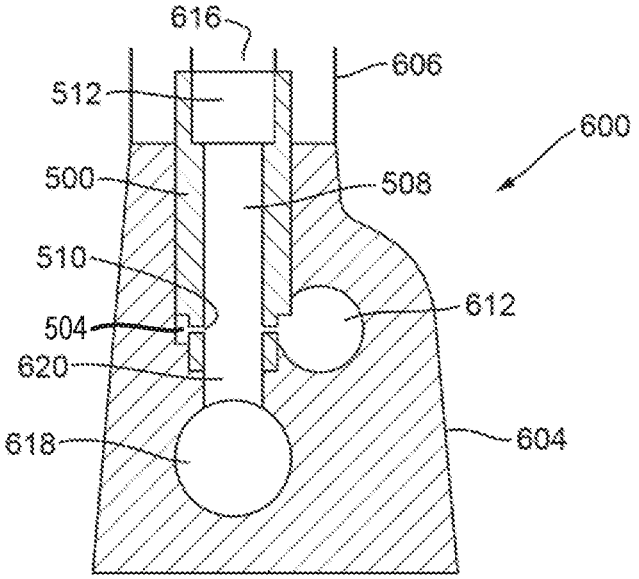
FIG. 7 is a section view of an alignment dowel according to another arrangement of the present disclosure installed within the engine assembly shown in FIG. 6.

With reference to FIGS. 6 and 7, an engine assembly 600 according to another arrangement of the disclosure comprises first and second engine housings 604, 606 and sump pan 610. The alignment dowel 500 is arranged within first and second bores 604*a*, 606*a* formed in the first and second engine housings 604, 606 respectively, to provide an alignment feature for locating the first and second housings relative to one another in the same way as in the engine assembly 100.

The second housing 606 and the sump pan 610 are similar to the second housing 106 and oil sump 110 (e.g., sump pan) described above. In particular, the second housing 606 comprises a second oil gallery 614, which is similar to the second oil gallery 114, and an oil passage 616 formed between the second oil gallery 614 and the second bore 606*a*.

The first housing 604 comprises a first oil gallery 612, which is similar to the first oil gallery 112 described above. The first housing 604 further comprises a third oil gallery 618. The third oil gallery 618 may also be formed within the first housing 604. Oil may be pumped to the third oil gallery 618 from the oil sump 110. Additionally or alternatively, oil may be provided to the third oil gallery 618 from the first oil gallery 612. It will be appreciated that an oil pump, similar to the oil pump 152 shown in FIG. 2, may flow oil from the oil sump 610 to the first oil gallery 612 and/or the third oil gallery 618, in one example. Additionally, fasteners may be used to connect the first housing 604 to the second housing 606.

In the arrangement shown in FIG. 6, the first oil gallery 612 is configured to provide oil to a first group of oil consuming components associated with the first housing 604 and the third oil gallery 618 is configured to provide oil to a second group of oil consuming components associated with the first housing 604.

In other arrangements, the first oil gallery 612 may be omitted and oil may be supplied from the third oil gallery 618 to each of the oil consuming components associated with the first housing 604.

As shown in FIGS. 6 and 7, oil may be supplied from the first and third oil galleries to the second housing 606, e.g., to the second oil gallery, via the alignment dowel 500. As depicted, the first oil gallery 612 may be arranged in fluid communication with the first bore 604*a* in the same way as the first oil gallery 112 and the first bore 104*a* described above. Additionally, a portion 620 of the third oil gallery 618 may be arranged in fluid communication with the first bore 604*a*.

In the arrangement depicted, the portion 620 extends in a direction substantially parallel with the main axis of the alignment dowel 500 where the portion 620 of the third gallery meets the dowel 500. However, in other arrangements, the portion 620 may extend in a direction substantially perpendicular to the alignment dowel 500 to meet the dowel 500.

As shown in FIG. 7, the central bore 508 of the restrictor dowel provides a flow channel for oil from the third oil gallery 618 to flow into the second housing 606. FIG. 7 also shows an oil channel 510 extending between the oil receiving groove 504 and the central bore 508.

In the arrangements described above, the first engine housing is a cylinder block and the second engine housing is a cylinder head. However, in other arrangements of the disclosure, the first and second engine housings may be any other housings of the engine assembly. For example, the cylinder head may be a two-part cylinder head comprising a first cylinder head housing configured to couple to the cylinder block, and a second cylinder head housing, also referred to as a camshaft carrier, configured to couple to the first cylinder head housing and support a camshaft of the engine assembly relative to the cylinder head. In such arrangements, the first housing may be the first cylinder head housing and the second housing may be the camshaft carrier.

It will be appreciated by those skilled in the art that although the invention has been described by way of example, with reference to one or more exemplary examples, it is not limited to the disclosed examples and that alternative examples could be constructed without departing from the scope of the invention as defined by the appended claims.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The technical effect of providing an engine assembly with an alignment dowel with an oil receiving groove is to decrease the likelihood of improper assembly of the alignment dowel in the oil galleries while providing a restriction in the galleries to generate a desired oil flow pattern in the lubrication system. Providing an alignment dowel which functions as a flow interface between oil galleries may also increase the compactness of the engine assembly.

It will be appreciated that the configurations disclosed herein are exemplary in nature, and that these specific embodiments are not to be considered in a limiting sense, because numerous variations are possible. For example, the above technology can be applied to V-6, I-4, I-6, V-8, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine assembly, comprising:

a first housing defining a first oil gallery;

a second housing defining a second oil gallery; and an alignment dowel received within the first and second housings to provide an alignment feature for locating the first and second housings of an engine assembly relative to one another, an exterior oil receiving groove extending across an outer surface of the alignment dowel and the exterior oil receiving groove positioned within the first and second housing such that oil flows from the first oil gallery through the exterior oil receiving groove to the second oil gallery; and a centerline of the exterior oil receiving groove extends in a direction with a component in a circumferential direction of the alignment dowel.

2. The engine assembly of claim 1, where the first oil gallery extends in a direction perpendicular to a main axis of the alignment dowel at a position where the first oil gallery meets the alignment dowel, and the exterior oil receiving groove positioned such that oil flows through the exterior oil receiving groove from the first oil gallery and then flows in the direction of the main axis of the alignment dowel.

3. The engine assembly of claim 2, where the first oil gallery meets the alignment dowel at a position of a circumferential exterior oil groove.

4. The engine assembly of claim 1, where the alignment dowel further comprises a central bore and an oil channel through the alignment dowel connecting the central bore and the exterior oil receiving groove.

5. The engine assembly of claim 4, where the first housing further defines a third oil gallery and where the alignment dowel and the third oil gallery are arranged such that oil from the third oil gallery flows through the oil channel to the central bore and then to the second oil gallery.

6. The engine assembly of claim 4, wherein the first oil gallery and an oil passage to the second oil gallery are perpendicular to one another, and the alignment dowel positioned such that oil flows from the first gallery through a circumferential exterior oil groove and oil channel before flowing through the central bore into the oil passage.

7. The engine assembly of claim 1, where the first oil gallery is within the cylinder block, the second oil gallery is within a cylinder head, and an oil passage extends perpendicular to the first and second oil galleries, and the alignment dowel is positioned within the oil passage.

8. An alignment dowel positioned within a first and a second housing of an engine assembly and configured to provide an alignment feature for locating the first and the second housing relative to one another, the alignment dowel comprising:

an exterior oil receiving groove extending across an outer surface of the alignment dowel oil and the exterior oil receiving groove positioned to receive oil from a first oil gallery of the first housing and flow the received oil to a second oil gallery of the second housing; and where a centerline of the exterior oil receiving groove extends in a direction with a component in a circumferential direction of the alignment dowel.

9. The alignment dowel of claim 8, where the centerline of the exterior oil receiving groove extends at least around a complete circumference of the alignment dowel and oil flows from the circumferential groove into an oil passage perpendicular to the first oil gallery.

10. The alignment dowel of claim 8, where the exterior oil receiving groove comprises a circumferential and an axial portion, and oil is received from the first oil gallery in the circumferential portion of the exterior oil receiving groove before flowing into the axial portion of the exterior oil receiving groove.

11. The alignment dowel of claim 8, where an oil flow area defined by the exterior oil receiving groove is sized to restrict oil flow from the first oil gallery to the second oil gallery.

12. The alignment dowel of claim 8, where the alignment dowel further comprises a central bore and an oil channel through the alignment dowel between the exterior oil receiving groove and the central bore.

13. The engine assembly of claim 1, wherein the exterior oil groove includes a circumferential exterior oil groove and a longitudinal exterior oil groove, and the exterior oil grooves are positioned such that oil flows form the first oil gallery into the circumferential exterior oil groove, then into the longitudinal exterior oil groove, and then into the second oil gallery.

14. The engine assembly of claim 1, wherein the alignment dowel comprises a longitudinal end face positioned in face sharing contact with a wall of the first or the second housing forming a perpendicular intersection.

15. The alignment dowel of claim 8, wherein the alignment dowel is positioned within an oil passage that extends perpendicular to the first and second oil galleries.

16. The alignment dowel of claim 12, wherein the central bore extends perpendicular to the first oil gallery.

17. The alignment dowel of claim 16, wherein the central bore extends parallel to an oil passage extending between the first and second oil galleries.

18. The alignment dowel of claim 16, wherein the alignment dowel includes two openings at the ends of the central bore and an oil channel formed through the alignment dowel between the exterior oil receiving groove and the central bore.

19. The alignment dowel of claim 18, wherein the two openings and the oil channel are each positioned to connect to a different oil passage.

* * * * *